US009328425B2

(12) United States Patent
He et al.

(10) Patent No.: US 9,328,425 B2
(45) Date of Patent: May 3, 2016

(54) DEVICE AND PROCESS FOR CONTINUOUSLY CLEANING SURFACE OF MOLYBDENUM WIRE AT HIGH TEMPERATURE

(75) Inventors: Qingchun He, Chengdu (CN); Qi Zhou, Chengdu (CN); Jian Li, Chengdu (CN)

(73) Assignee: CHENGDU HONGBO INDUSTRIAL CO., LTD., Chengdu, Sichuan ( * ) Notice: Subject to any disclaimer, the term of this patent is extended or adjusted under 35 U.S.C. 154(b) by 871 days.

(21) Appl. No.: 13/521,347

(22) PCT Filed: Aug. 10, 2011

(86) PCT No.: PCT/CN2011/078177

§ 371 (c)(1),
(2), (4) Date: Jul. 10, 2012

(87) PCT Pub. No.: WO2012/022233

PCT Pub. Date: Feb. 23, 2012

(65) Prior Publication Data

US 2012/0291807 A1 Nov. 22, 2012

(30) Foreign Application Priority Data

Aug. 20, 2010 (CN) ..... 2010 1 0258482

(51) Int. Cl.

| | |
|---|---|
| ***C23G 5/00*** | (2006.01) |
| ***C22F 1/18*** | (2006.01) |
| ***C22C 27/04*** | (2006.01) |

(52) U.S. Cl.

CPC . *C23G 5/00* (2013.01); *C22C 27/04* (2013.01); *C22F 1/18* (2013.01)

(58) Field of Classification Search

CPC ..... B21C 43/04; C23G 5/00; C22F 1/18
See application file for complete search history.

(56) References Cited

U.S. PATENT DOCUMENTS

| | | | | |
|---|---|---|---|---|
| 3,725,729 | A * | 4/1973 | McDermott | H01T 2/02 307/100 |
| 3,727,125 | A * | 4/1973 | Mourier | G01R 5/28 324/455 |
| 6,471,920 | B2 * | 10/2002 | Aigner | B08B 7/0035 204/164 |
| 2006/0108034 | A1 * | 5/2006 | Frommann | B08B 7/0035 148/565 |
| 2009/0114621 | A1 * | 5/2009 | Eiselt et al. | 216/69 |

FOREIGN PATENT DOCUMENTS

| | | | |
|---|---|---|---|
| CN | 101368287 | A | 2/2009 |
| CN | 101649437 | A | 2/2010 |

(Continued)

*Primary Examiner* — Jason Ko
*Assistant Examiner* — Spencer Bell
(74) *Attorney, Agent, or Firm* — Mei & Mark LLP

(57) ABSTRACT

A device for cleaning the surface of a molybdenum wire at high temperature, comprises a wire pay-off mechanism, a first wire guiding wheel, a cleaning mechanism, a second wire guiding wheel, and a wire take-up mechanism; wherein the two ends of a furnace body of the cleaning mechanism are provided with an inlet hole and an outlet hole for the molybdenum wire. Electrodes connected to a power supply are provided at the inlet hole and in a central part inside the furnace body. An upper part of the furnace body is provided with a gas outlet and a lower part thereof is provided with a wet hydrogen inlet; a heating section is formed between the electrode located at the inlet hole and the electrode located in the central part, and a cooling section is formed between the electrode located in the central part and the outlet hole.

17 Claims, 2 Drawing Sheets

(56) References Cited

FOREIGN PATENT DOCUMENTS

| | | | |
|---|---|---|---|
| CN | 101892447 | A | 11/2010 |
| CN | 201720566 | U | 1/2011 |
| CN | 201762452 | U | 3/2011 |
| WO | WO 2007/087661 | A1 | 8/2007 |

* cited by examiner

DEVICE AND PROCESS FOR CONTINUOUSLY CLEANING SURFACE OF MOLYBDENUM WIRE AT HIGH TEMPERATURE

This is a §371 National Stage Application of PCT Application No. PCT/CN2011/078177, filed Aug. 10, 2011, which claims the benefit of Chinese Patent Application No. 201010258482.2, filed Aug. 20, 2010. This application claims the benefit of the two prior applications and incorporates the contents thereof by reference in their entireties.

TECHNICAL FIELD

The invention relates to a device and method for continuous cleaning of the molybdenum wire surface at a high temperature.

BACKGROUND

In the molybdenum wire drawing process, graphite emulsion is used to be coated on the molybdenum wire surface. After drying, the graphite emulsion coating forms a protective layer and high temperature lubricant (prevent the Metal oxide of the molybdenum wire surface in the drawing process). Therefore, the wire surface has a mixture layer of carbon and molybdenum oxide, which can be divided into different chemical structures from surface to metal substrate roughly: Carbon→Carbon+molybdenum oxide→molybdenum oxide→molybdenum.

The impurities of carbon and molybdenum oxide on the molybdenum wire surface will affect the following production and the quality of final products seriously. For example, when the molybdenum wire is used for the energy-saving filament, if the carbon exists on the surface, carbon and molybdenum will react and occur the molybdenum carbide at high temperature, it will not only lead to the brittle fracture of molybdenum wire, but also damage the tungsten wire around the core line. And it will strongly influence the service life of the lamp if the tungsten filament is sealed in the lamp, which contaminated with carbon and oxygen. Therefore, the layer of impurities on the surface, such as the carbon, molybdenum oxide and so on must be removed prior to using. The prior art for molybdenum wire surface be cleaned by electrolytic methods. The wire will be cleaned continuous at electrolyzer. The graphite, the molybdenum oxide and a few molybdenum metal will be dissolved into the electrolytic near the anode and the gas is released near the cathode between a set of electrodes.

The electrolytic cleaning has the following disadvantage:

1. The corrosive gases are occurred in the process of electrolytic cleaning, which will corrupt the equipment and other facilities nearby, endanger the health of the operator, and pollute the atmospheric environment.

2. The cost is very high for the treatment of the waste electrolytic liquid, and the emissions will pollute the surrounding water system even after diluted.

3. Carbon and molybdenum oxides on the wire surface be removed by electrolytic cleaning, but it is inevitable to lead to the molybdenum metal on the surface be dissolving into the electrolyte and cause molybdenum losses.

4. The method can not eliminate the processing stress of molybdenum wire drawing process.

In addition, in order to ensure the accuracy of the product, before the electrolytic cleaning of the molybdenum wire, sometimes a separate stress relief annealing is needed. It will not only extend the production cycle, but also increases production costs.

CONTENTS OF THE INVENTION

The present invention is based on the object of providing a device and a method for continuous cleaning of the molybdenum wire surface at a high temperature, through which the disadvantages of the prior art can be avoided.

The present invention comprises a wire feeding unit, a first wire guiding wheel, a wire cleaning unit, a second wire guiding wheel, and a wire take-up unit successively; wherein the wire cleaning unit includes a furnace body, and there is an inlet hole and an outlet hole at the both ends of the furnace body respectively. Electrodes are installed in connection with the power supply at the inlet hole and in a center inside the furnace, and the space from the electrodes at the wire inlet hole to the electrodes in the center forms a heating zone, and the space from the electrodes in the center to the wire outlet hole electrodes forms a cooling zone. A gas outlet on the upper part of the furnace, a wet hydrogen inlet on the lower part of the furnace has been designed.

The molybdenum wire comes from the wire feeding unit, via the first wire guiding wheel into the wire inlet hole and via the electrodes there and the electrodes in the center and out off from the wire outlet hole at another end of the furnace, further via the second wire guiding wheel, and will be winded on a reel of the wire take-up unit. When the wire feeding unit is going to be driven, the molybdenum wire will come out from the wire feeding unit, and then the molybdenum wire between the two electrodes will form a closed loop with the power supply. The molybdenum wire will be heated to a temperature between 750~1200° C. in the heating zone. The carbon and molybdenum oxide on the wire surface react a thermo-chemical way with the inputted wet hydrogen in the furnace, through which the impurities on the wire surface will be removed and the stress arising from the wire drawing process will also be eliminated simultaneously. The cleaning wire will pass through the outlet hole after gradual cooling in the cooling zone, then via the second wire guiding wheel, and will be winded on a reel by the wire take-up unit.

Furthermore, it is preferred that the furnace body diameter of the cooling zone near the wire outlet hole is only one third to one half of the diameter of the heating zone, and the length of the cooling zone is only two thirds to four fifths of the distance from the electrode in the center to the wire outlet hole. Through which the cooling effect will be apparently improved.

The electrode in the center will be fixed on an electrode pedestal, which is connected to the power supply. It is easy to fix the electrode.

Furthermore, there is a blind hole on the top of the electrode pedestal. And the electrode will be interference fitted into the blind hole. It is very simple and convenient.

Furthermore, the electrode is made of an tungsten wire coiled ball with the features of good wear resistance, good burn resistance, and good electrical conductivity. The electrode ensures a stable and reliable contact when the molybdenum wire passes through the electrode. A smaller diameter of the tungsten wire less than 20 μm enables a better contact of the molybdenum wire with the electrode.

Furthermore, there is an operation hole on the furnace body. It is easy to put the molybdenum wire into and draw it out off the furnace body, when the operation hole will be opened. The operation hole will be closed, when it is not in use.

As described above, the invention with the above technical solutions has the following beneficial effects:

1. The harmful substances on the molybdenum wire surface, such as the carbon, molybdenum oxide etc will be removed and the surface will be cleaned by thermo-chemical methods, and at the same time stress arising from the molybdenum wire drawing process will also be eliminated.

2. No waste liquids or corrosive gases will occur in the production process.

3. A material save of about 4% is available in comparison with the electrolytic method.

DESCRIPTION OF THE DRAWINGS

The invention is now illustrated in further detail exemplary embodiment, with reference to the drawings.

SPECIFIC EMBODIMENTS

All the characteristics or the processes and steps disclosed in the invention can be combined in any ways except for the characteristics and/or steps excluding each other.

Any of the characteristics disclosed in the invention (including any additional claims, abstracts and drawings), unless otherwise stated, may be replaced by equivalent or other similar characteristics. It means, unless otherwise stated, every characteristic is just one example of a series of equivalent or similar features.

Figure 1:
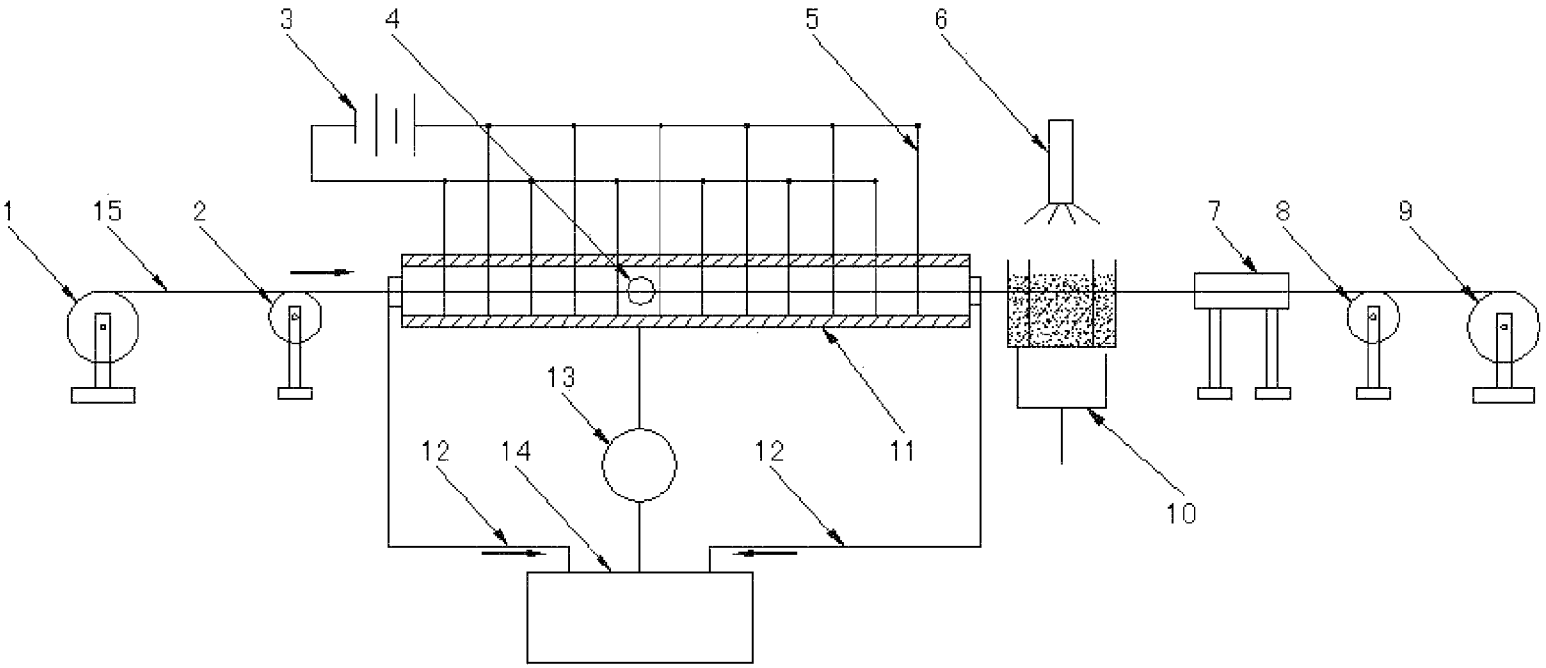
FIG. 1 PRIOR ART
FIG. 1 is a diagram of a device for cleaning the molybdenum wire surface according to prior art.

FIG. 1 shows that the prior art cleaning device of the molybdenum wire comprises successively, wire feeding unit 1, first wire guiding wheel 2, the electrolytic wire cleaning unit, spraying unit 6, stoving furnace 7, wire guiding wheel 8 and the wire take-up unit 9. And wire cleaning unit comprises: several electrodes 5 placed in a electrolytic multi-section of plexiglass 11, DC power supply 3 connected to the electric circuit, electrolyte inlet 4, flowing back pipe 12 of electrolyte from cell to tank 14, pump 13 is for pumping from tank into cell. Install the molybdenum wire reel to the wire feeding unit 1, and the molybdenum wire 15 to be cleaned will be fed via the wire guiding wheel 2 into the electrolytic cleaning unit, and will be cleaned continuously there. The graphite, the molybdenum oxide and a few molybdenum metal will be dissolved into the electrolytic near the anode and the gas is released near the cathode between a set of electrodes 5. After cleaning, the molybdenum wire will be sprayed with water to removed residue electrolyte on the wire surface. Then stoved, and received by the wire take-up unit via the wire guiding wheel 8 finally, the water will be recycled through the pipe 10.

Figure 2:
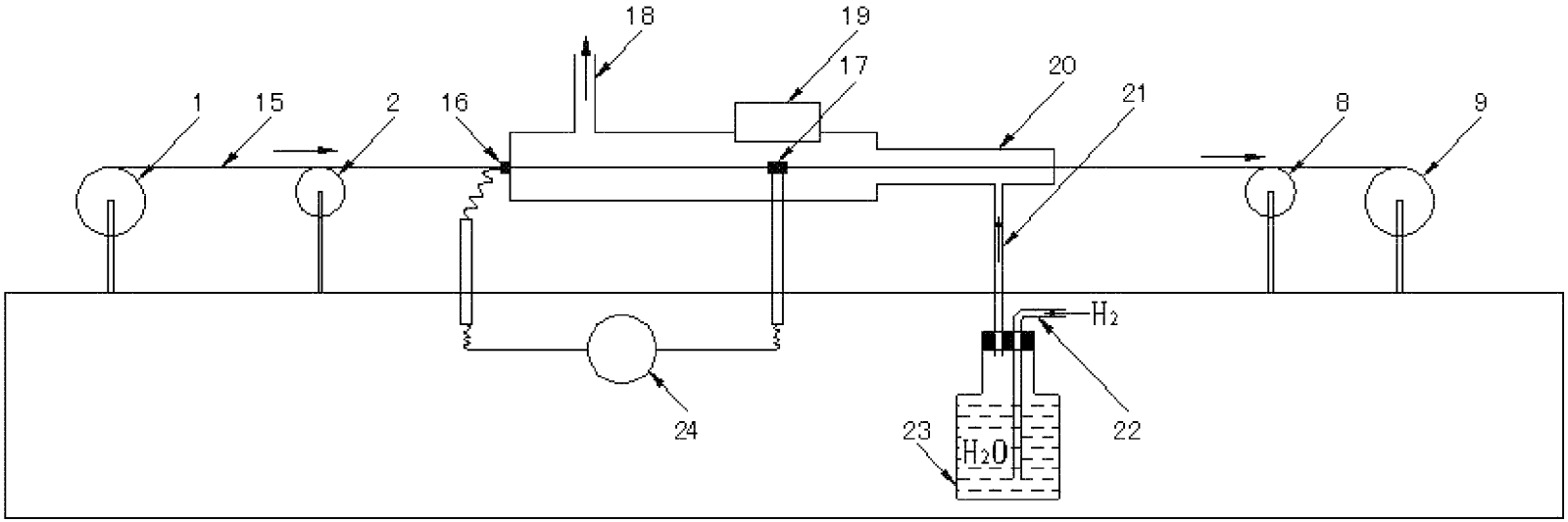
FIG. 2 is a structural schematic diagram of examples according to the present invention.

FIG. 2 shows the structural schematic diagram of the invention. It comprising in succession a device consists of wire feeding unit 1, first wire guiding wheel 2, a cleaning unit, second wire guiding wheel 8, wire take-up unit 9. The cleaning unit comprises a furnace body, and on the both ends of the furnace body, there is a wire inlet hole and a wire outlet hole respectively. An electrode 16 is fixed at the wire inlet hole and is connected to the power supply 24 through the circuit. The electrode 17 in the center inside the furnace is interference fitted in the blind hole of the electrode pedestal, which is connected to the power supply 24. The room between electrode 16 and electrode 17 forms the heating zone, and the room between the electrode 17 and the wire outlet hole forms the cooling zone of the furnace. The diameter of furnace body near the wire outlet hole for the cooling zone is one third to one half of that for the heating zone, and the length of the cooling zone is two third to four fifth of the distance from the furnace body center to the wire outlet hole. With such a structure, the cooling effect of the cooling zone can be improved apparently. An wire ball winded with the tungsten wire of a diameter less than 20 μm is preferred as electrode. There is also an operation hole 19 to be designed on the furnace body. A gas outlet 18 is designed on the furnace body on the upper furnace body part of heating zone. Hydrogen ($H_2$) flows through the pipe 22 into a water container to form wet hydrogen and the wet hydrogen flows further through the pipe 21 into the lower part of the furnace body; and it is preferable that the pipe 21 is fitted under the cooling zone of the furnace. The wet hydrogen can also be got by humidifying (eg. humidifier).

The molybdenum wire 15 to be treated come from the wire feeding unit, via the first wire guiding wheel, passes the electrodes 16 and electrodes 17 by opening the operation hole, then come out from the wire outlet hole. Meanwhile the operation hole will be closed. Via the second wire guiding wheel, and be winded to a wire reel of the wire take-up unit finally. Drive the wire feeding unit, when the molybdenum wire passes through between the two electrodes with a constant speed, the molybdenum wire forms a closed loop with the power supply resulting to a resistance, which will heated the molybdenum wire to a temperature between 750~1200° C., and make a thermal chemical reaction with the wet hydrogen in the heating zone, that to remove the carbon and molybdenum oxide on the surface of molybdenum wire. The end gas will be exhausted from the wet hydrogen outlet. The cleaned molybdenum wire will be cooled gradually to less than 100° C. in the cooling zone of the furnace, come out from the wire outlet hole, via the second wire guiding wheel, and be winded on the reel by the wire take-up unit finally. The cleaning device and method described above not only can remove the harmful substances on the surface, such as carbon, molybdenum oxide and so on, to clean the surface of molybdenum wire, but also eliminates the accumulated stress arising from the molybdenum wire drawing process simultaneously, no waste liquids or corrosive gases will arise in the production process. Therefore, the cleaning device described herein is a better one.

The present invention is not limited to the aforementioned specific details of the examples. The present invention will extend to any new features or new combination disclosed in this invention and the disclosed any new method or steps, or new combination.

We claim:

1. A device for continuously cleaning molybdenum wire at high temperature, comprising:

a molybdenum wire comprising an impurity to be cleaned;

a wire feeding unit;

a first wire guiding wheel;

a wire cleaning unit comprising:

a furnace body comprising:

an inlet hole with a first electrode;

an outlet hole;

a second electrode substantially at the center of the furnace body;

a gas outlet at an upper part;

a wet hydrogen inlet at a lower part; and a wet hydrogen atmosphere between the gas outlet and the wet hydrogen inlet;

a second wire guiding wheel; and a wire take-up unit, wherein the space from the first electrode to the second electrode forms a heating zone, and the space from the second electrode to the outlet hole forms a cooling zone, and wherein the molybdenum wire forms a closed loop with the first electrode and with the second electrode and a resulting resistance heats the molybdenum wire to react the impurity on the molybdenum wire with the wet hydrogen atmosphere.

2. The device of claim 1, further comprising a power supply between the first electrode and the second electrode.

3. The device of claim 1, wherein the furnace body comprises a cooling zone diameter near the outlet hole and a heating zone diameter, and the cooling zone diameter is between one third to one half of the heating zone diameter.

4. The device of claim 1, wherein the cooling zone comprises a length two thirds to four fifths of a distance from the second electrode to the outlet hole.

5. The device of claim 4, further comprising an operation hole in the furnace body.

6. The device of claim 1, further comprising an electrode pedestal, wherein the second electrode in the center of the furnace body is fixed on the electrode pedestal.

7. The device of claim 6, further comprising a blind hole in the electrode pedestal, wherein the second electrode is interference-fitted into the blind hole.

8. The device of claim 1, wherein each of the first electrode and the second electrode comprise a tungsten wire ball.

9. The device of claim 8, wherein the tungsten wire ball comprises tungsten wire, and a diameter of the tungsten wire is less than 20 μm.

10. The device of claim 1, further comprising an operation hole in the furnace body.

11. The device of claim 1, further comprising a supply of wet hydrogen configured to supply hydrogen to the wet hydrogen inlet.

12. A device for continuously cleaning molybdenum wire at high temperature, comprising:

a wire feeding unit;

a first wire guiding wheel;

a wire cleaning unit comprising:

a furnace body comprising:

an inlet hole with a first electrode;

an outlet hole;

a second electrode substantially at the center of the furnace body;

a gas outlet at an upper part;

a wet hydrogen inlet at a lower part; and a wet hydrogen atmosphere between the gas outlet and the wet hydrogen inlet;

a second wire guiding wheel;

a power supply electrically connected to the first electrode and the second electrode; and a wire take-up unit, wherein the space from the first electrode to the second electrode forms a heating zone, and the space from the second electrode to the outlet hole forms a cooling zone, and wherein, when a molybdenum wire forms a closed loop with the power supply, the resulting resistance heats the molybdenum wire to react an impurity on the molybdenum wire with the wet hydrogen atmosphere.

13. The device of claim 12, wherein the furnace body comprises a cooling zone diameter near the outlet hole and a heating zone diameter, and the cooling zone diameter is between one third to one half of the heating zone diameter.

14. The device of claim 12, wherein the cooling zone comprises a length two thirds to four fifths of a distance from the second electrode to the outlet hole.

15. A method for continuous cleaning of molybdenum wire at high temperature, comprising the steps of:

feeding molybdenum wire from a wire feeding unit;

guiding the molybdenum wire via a first wire guiding wheel into a wire inlet hole in a furnace body and to a first electrode in the wire inlet hole, through a wet hydrogen atmosphere, then to a second electrode inside the furnace body, and out of a wire outlet hole in the furnace body;

further guiding the molybdenum wire via a second wire guiding wheel, and winding the molybdenum wire on a reel of a wire take-up unit, wherein:

the space from the first electrode to the second electrode forms a heating zone, the space from the second electrode to the wire outlet hole forms a cooling zone, and a section of molybdenum wire between the first electrode and the second electrode forms a closed loop with a power supply, thereby heating the section to a temperature between 750~1200 degrees Centigrade in the heating zone.

16. The method of claim 15, further comprising gradually moving the section of molybdenum wire to the cooling zone and gradually cooling the section to a temperature lower than 100 degrees Centigrade, and thereafter passing the section through the wire outlet hole for winding on the reel by the take-up unit.

17. The method of claim 16, further comprising supplying wet hydrogen to the furnace body, wherein the heating causes a thermo-chemical reaction for removing carbon and molybdenum oxide on the section to thereby clean the section.

* * * * *